US007387224B1

(12) United States Patent
Backus

(10) Patent No.: US 7,387,224 B1
(45) Date of Patent: Jun. 17, 2008

(54) SADDLEBAG BUCKET CARRIER AND METHOD OF MAKING

(76) Inventor: Philip C. Backus, 4295 Franklin TRC, Sterling, MI (US) 48659

( * ) Notice: Subject to any disclaimer, the term of this patent is extended or adjusted under 35 U.S.C. 154(b) by 194 days.

(21) Appl. No.: 10/667,731

(22) Filed: Sep. 22, 2003

(51) Int. Cl.
*B60R 9/00* (2006.01)

(52) U.S. Cl. ..... 224/42.11; 294/159; 224/251

(58) Field of Classification Search ..... 224/42.11, 224/408, 401, 429, 260, 413, 430, 250, 251, 224/901, 901.2; 206/428, 549, 150, 217, 206/446, 143; 248/210, 211, 238, 311.2; 119/792, 793, 856; 54/37.1; 294/159
See application file for complete search history.

(56) References Cited

U.S. PATENT DOCUMENTS

| | | | | |
|---|---|---|---|---|
| 417,220 | A | 12/1889 | Bell | |
| 1,136,691 | A | 4/1915 | Mease | |
| 1,380,994 | A | 6/1921 | McNary | |
| 2,092,456 | A * | 9/1937 | Hunker | 294/159 |
| 4,391,396 | A | 7/1983 | Brady | |
| D272,428 | S | 1/1984 | Kelley | |
| 4,756,455 | A | 7/1988 | Kitner | |
| 4,867,359 | A * | 9/1989 | Donovan | 224/602 |
| 4,955,516 | A | 9/1990 | Satterfield | |
| 4,984,724 | A * | 1/1991 | Johnston | 224/257 |
| 5,031,807 | A | 7/1991 | Tiffany | |
| 5,711,433 | A * | 1/1998 | Smith | 211/71.01 |
| 5,813,579 | A | 9/1998 | Hendrickson | |
| 6,032,808 | A * | 3/2000 | Henson | 211/85.23 |
| 6,032,841 | A * | 3/2000 | Johnson | 224/463 |
| 6,179,180 | B1 | 1/2001 | Walker | |
| 6,357,639 | B1 * | 3/2002 | Williams | 224/222 |
| 6,547,113 | B1 * | 4/2003 | Hancock et al. | 224/408 |

* cited by examiner

*Primary Examiner*—Nathan J. Newhouse
*Assistant Examiner*—Justin M Larson
(74) *Attorney, Agent, or Firm*—Robert L. Farris; Farris Law, P.C.

(57) ABSTRACT

The saddle bag bucket carrier is constructed from a one piece blank cut from a sheet of rubber material. The blank has a central strip with a left end and a right end. A left front band portion and a left rear band portion are integral with the strip left end and have their free ends connected together by an adhesive to form a left bucket band with a left bucket receiving passage. A right front band portion and a right rear band portion are integral with the strip right end and have their free ends connected together by an adhesive to form a right bucket band with a right bucket receiving passage. Both bucket receiving passages are conical and receive buckets with frustoconical walls. The bucket bands have a vertical height that exceeds one-third the height of a bucket to be received.

3 Claims, 4 Drawing Sheets

SADDLEBAG BUCKET CARRIER AND METHOD OF MAKING

TECHNICAL FIELD OF THE INVENTION

The bucket carrier is made from a single sheet of rubber material and includes two bucket encircling bands connected by a central strip that is draped over a vehicle structure such as a snowmobile seat and carries two plastic buckets with frustoconical walls.

BACKGROUND OF THE INVENTION

Sportsmen such as ice fishermen need to carry fishing gear, ice augers, fish bait, food and drink for themselves and other equipment to keep them warm and dry while on the ice. If they are successful, they also need to carry fish off the ice. Frequently, ideal fishing locations are a substantial distance from where there is access to the ice.

Vehicles such as snowmobiles and all-terrain vehicles are suitable for transportation on frozen lakes and streams. They are capable of transporting a person several miles in a short period of time. Unfortunately, their ability to carry cargo is very limited. Snowmobiles do not have a cargo compartment. All-terrain vehicles generally have a rack of some type that cargo can be tied to. Both snowmobiles and all-terrain vehicles can pull a sled or small trailer. Operators of these vehicles generally prefer not to pull sleds or trailers on ice.

Ice fishermen use ice shanties while fishing to obtain protection from the elements. Some ice shanties are mounted on runners and can be pulled by a snowmobile like a sled. If an ice shanty is pulled by a snowmobile, another sled or trailer most likely would not be pulled.

Motorcycles, bicycles and some personal watercraft need to carry cargo at times. Various carriers can be obtained for use with such vehicles. Plastic buckets that hold five gallons or more are suitable containers for transporting a large variety of items used by sportsmen and others. Unfortunately, it is difficult to attach such buckets to vehicles.

SUMMARY OF THE INVENTION

The bucket carrier is a one piece member made from a sheet of rubber or other flexible and resilient material. The sheet material is cut to form a one piece bucket carrier blank. The blank includes a central strip with a left end and a right end. A left side front band portion and a left side rear band portion are both integral with the left end of the central strip. The blank also includes a right side front band portion and a right side rear band portion that are both integral with the right end of the central strip.

The left side front band portion includes a left arcuate upper edge integral with the left end of the central strip. The left side front band portion also includes a left arcuate lower edge and a left side front band free end. The left side rear band portion is integral with the central strip and the left side front band portion. The right side front band portion includes a right arcuate upper edge integral with the right end of the central strip. The right side front band portion also includes a right arcuate lower edge and a right side front band free end. The right side rear band portion is integral with the central strip and the right side front band portion. A left side joint connects the left side free end to the left side rear band portion to form a frustoconical left bucket band with a left band vertical height that is at least one-third the height of the buckets to be carried and forms a left bucket receiving passage with a left bucket upper diameter that exceeds a left bucket passage lower diameter. The right side joint connects the right side free end to the right side rear band portion to form a frustoconical right bucket band with a right band vertical height that is at least one-third the height of buckets to be carried and forms a right bucket receiving passage with a right passage upper diameter that exceeds the right passage lower diameter.

A left upper tongue is integral with the upper edge of the left bucket band. A right upper tongue is integral with the upper edge of the right bucket band. The upper tongues are manually held outward and upward when inserting buckets into the left and right bucket receiving passages.

A left lower tongue is integral with the left lower edge of the left bucket band. A right lower tongue is integral with the lower edge of the right bucket band. The lower tongues are manually held down when extracting buckets from the left and right bucket receiving passages.

BRIEF DESCRIPTION OF THE DRAWINGS

These and other objects, features and advantages will become more readily apparent in view of the following detailed description and best mode, appended claims and accompanying drawings, in which:

DETAILED DESCRIPTION OF THE PREFERRED EMBODIMENTS

The terms left, right, front and rear are relative to a person standing at the rear of the snowmobile and facing in the direction of forward movement of the snowmobile.

The bucket carrier 10 is made from a sheet of rubber roofing material for rubber membrane roofs sold by Duro-Last, Inc. of Saginaw, Mich. Rubber sheeting with substantially the same weight and elasticity from other manufacturing companies would work as well.

Figure 4:
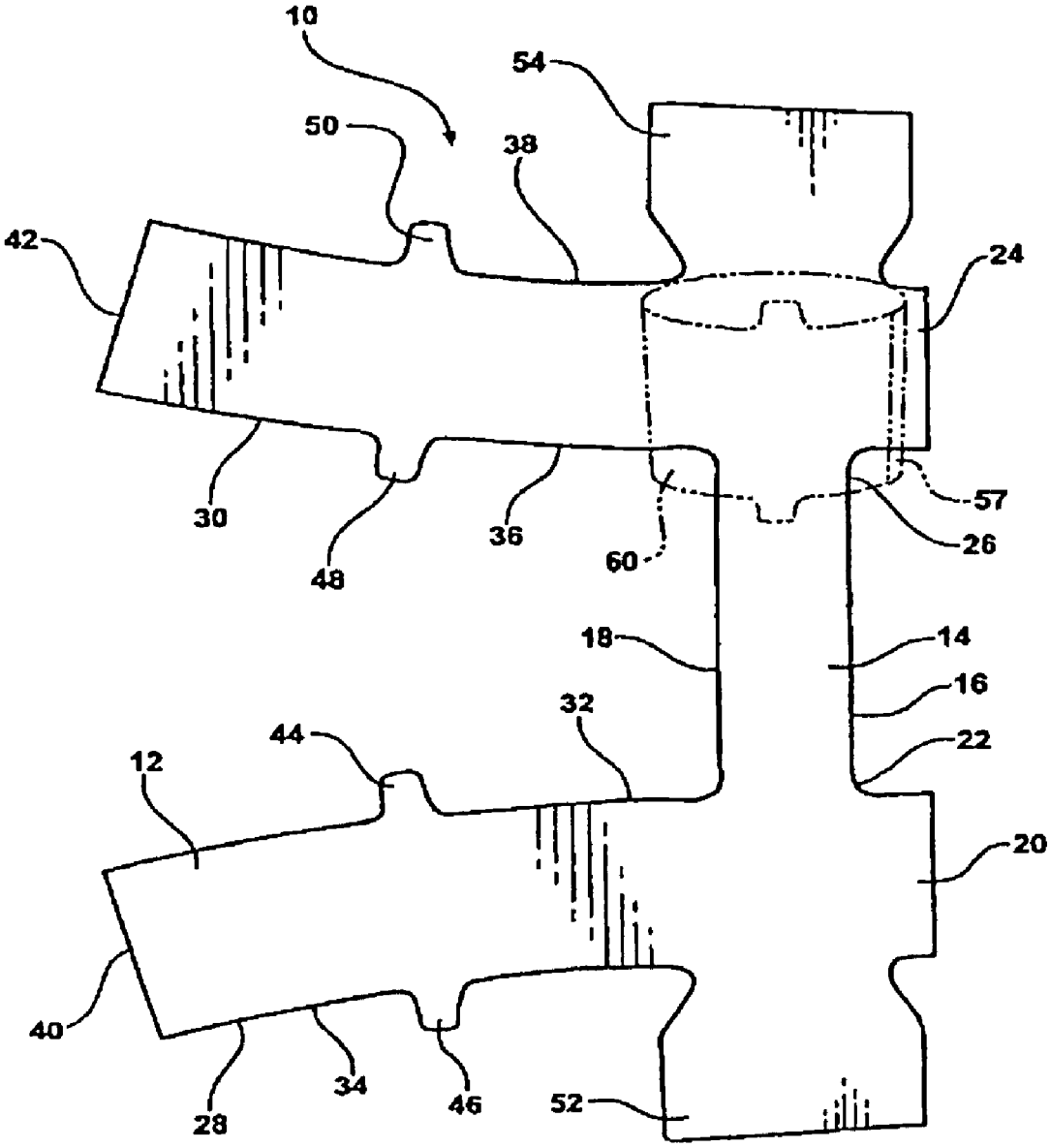
FIG. 4 is a plan view of the bucket carrier blank in a flat condition prior to forming the bucket receiving bands.

The bucket carrier blank 12 at, as shown in FIG. 4, is cut from a sheet of rubber roofing material. The carrier blank 12 has a central strip 14 with front and rear straight parallel edges 16 and 18. A short band portion 20 extends rearward from the left end 22 of the central strip 14. A short band portion 24 extends rearward from the right end 26 of the central strip 14. A long band portion 28 extends forward from the left end 22 of the central strip 14. A long band portion 30 extends forward from the right end 26 of the central strip 14. The long band portion 28 has an upper edge 32 that is arcuate and longer than the arcuate lower edge 34. The long portion 30 has an upper edge 36 that is arcuate and longer than the arcuate lower edge 38. The free end 40 of the long band portion 28 is substantially perpendicular to tangents to the upper edge 32 and the lower edge 34 at their points of intersection. The free end 42 of the long band portion 30 is substantially perpendicular to tangents to the upper edge 36 and the lower edge 38 at their points of intersection. The long band portion 28 and the long band portion 30 extend forward from the central strip 14 and diverge from each other when the bucket carrier blank 12 is in a flat position as shown in FIG. 4.

The long band portion 28 has an upper tongue 44 that extends outward from the upper edge 32 and a lower tongue 46 that extends outward from the lower edge 34. The long band 30 has an upper tongue 48 that extends outward from the upper edge 36 and an upper tongue 50 that extends outward from the lower edge 38. A left side bucket anti-abrasion flap 52 extends outward from the central strip 14 and past the lower edge 38. A left side anti-abrasion flap 52 extends outward from the central strip 14 and past the lower edge 34. A right side anti-abrasion flap 54 extends outward, from the opposite end of the central strip 14 from the anti-abrasion flap 52, and past the lower edge 38.

To create a bucket carrier 10 from the carrier blank 12, the free end 40 of the long band 28 overlaps the short band portion 20 and is secured to the short band portion 20 by an adhesive 56 to form a left joint 57 and a left bucket band 58. The free end 42 of the long band portion 30 overlaps the short band portion 24 and is secured to the short band portion 24 by an adhesive 56 to form a right joint 57 and a right bucket band 60.

Figure 2:
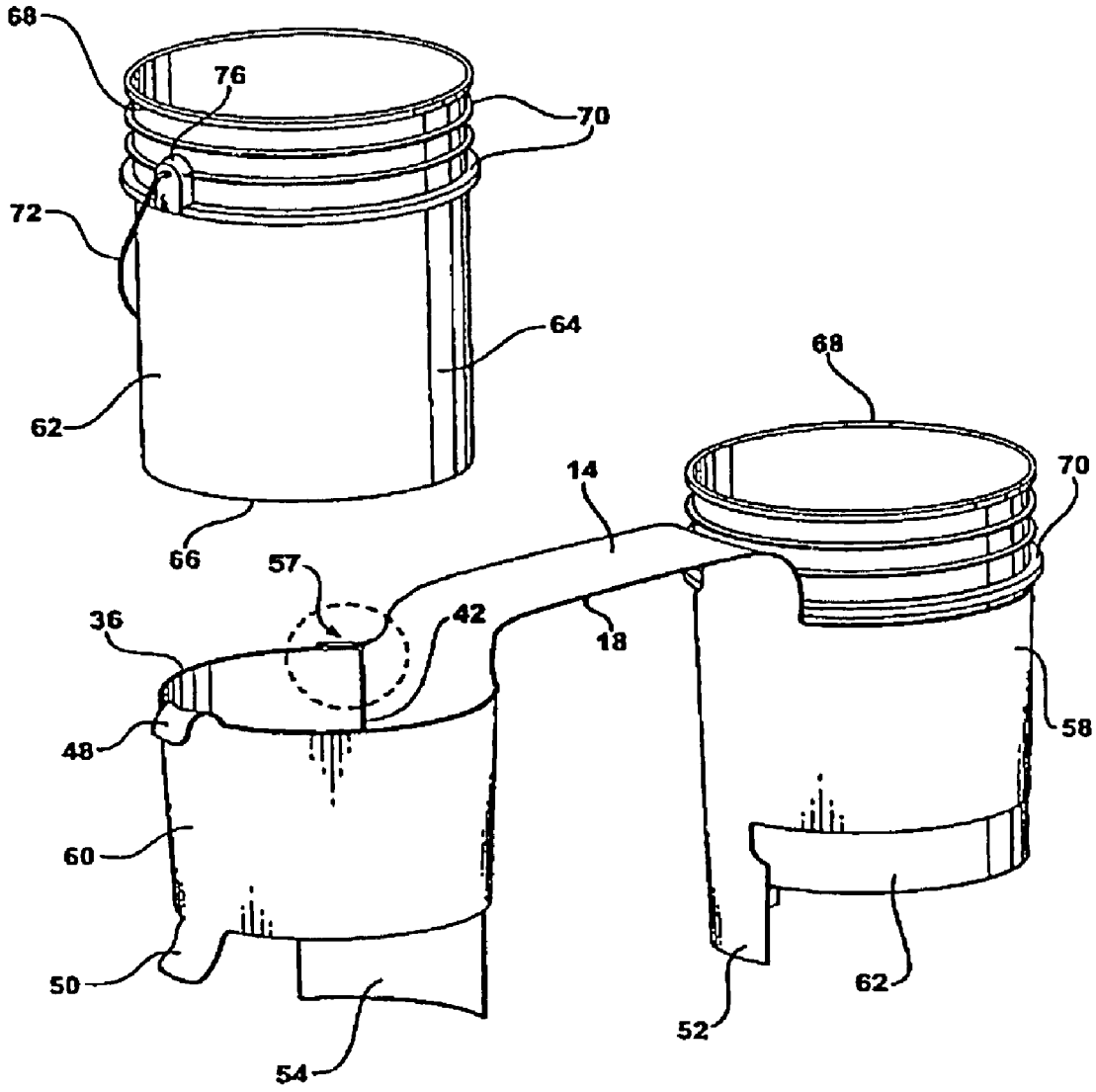
FIG. 2 is an expanded front perspective view of the bucket carrier with one bucket held by the carrier and another bucket in position to be inserted into the carrier.
Figure 3:
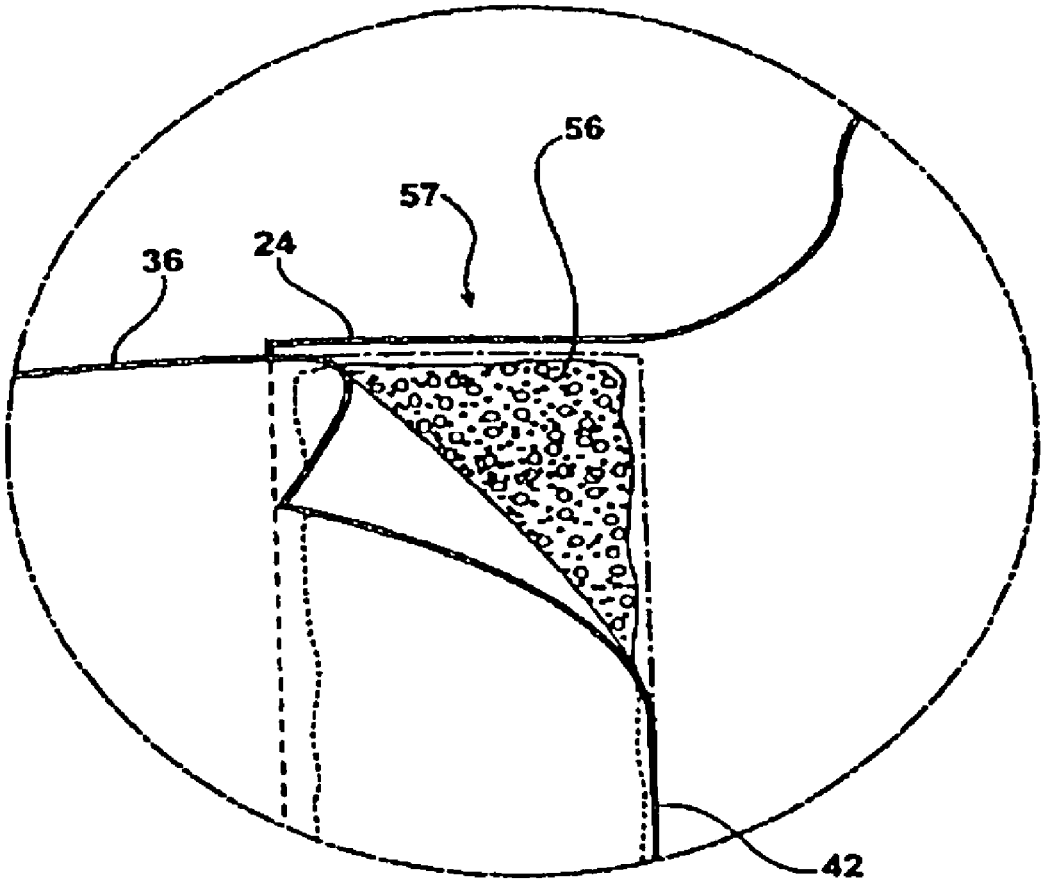
FIG. 3 is an enlarged view of a joint in area 3 in FIG. 2.

The bucket, shown in FIG. 2, is a molded plastic member that is used extensively for products such as lubricants, paint, wet plaster and pickles. These buckets 62 generally have capacities between five gallons and ten gallons. The side walls 64 are frustoconical. A reinforced bottom wall 66 is integral with the side wall 64. A lid engaging flange 68 is integral with the open top of the side wall 66. Reinforcing flanges 70, extending radially outwardly from the side wall 64 below the lid flange 66, may be provided. These reinforcing flanges 70 may also be used to position buckets in filling machines. A bale 72 is generally attached to bale receiver 76 molded on the side wall 64 between the reinforcing flanges 70. The bale 72 is a metal rod with its ends pivotally received in the bale receivers 76.

The side walls 64 are conical as stated above so that the bucket 62 can be nested for storage and shipping before they are filled. The bottom flange 70 of one bucket 72 contacts the lid engaging flange 68 of another bucket to limit the distance one bucket is telescopically received in another bucket and thereby insure that two buckets are not locked together.

During construction of the bucket carrier 10, the carrier blank 12 is cut from a sheet of rubber material with a thickness of 45 to 60 mils. The short band portion 20 and the long band portion 28 are wrapped around a bucket 62 to insure that the bucket band 58 has the proper conical shape and the proper diameter. The proper diameter is obtained by placing the lower edge 34 or 38 closer to the bottom 60 of the bucket 62 then will be the position during use. The free ends 40 and 42 of portions 28 and 30 are then glued together by an adhesive 56. The roofing material seam could also be formed by heat rather than by an adhesive if desired. A roofer's adhesive works well. An overlap between the free end 40 and the short end portion 20 of two to four inches works well. After the bucket band 58 is formed the bucket band 60 is formed following the same procedure.

Figure 1:
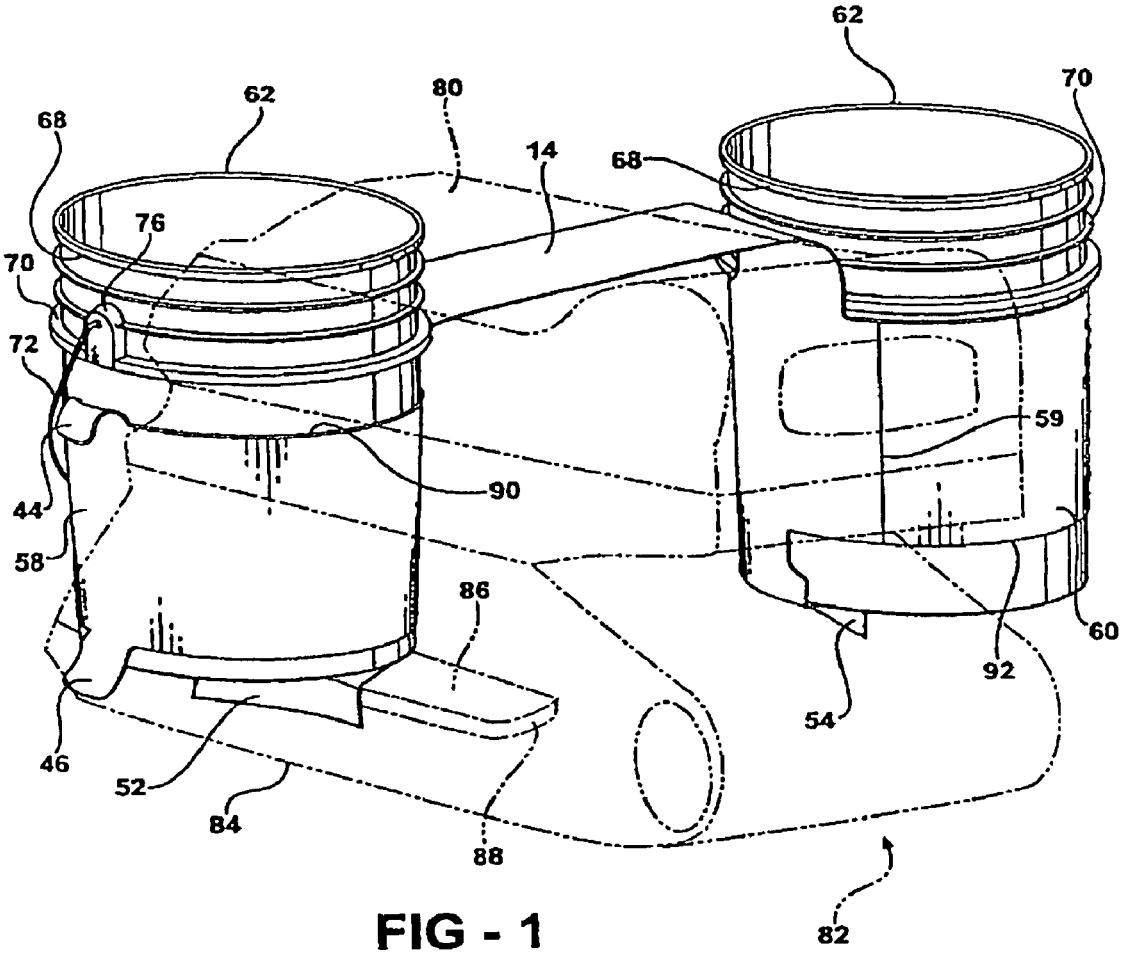
FIG. 1 is a perspective view of the bucket carrier with two buckets on a snowmobile.

During use, the bucket carrier 10 is positioned over a portion of a vehicle. As shown in FIG. 1, the bucket carrier 10 is draped over the seat 80 of a snowmobile 82. The central strip 14 of the bucket carrier 10 is stretched across the top of the seat 80. The operator of the snowmobile 82 or a passenger on the snowmobile can sit on the central strip 14. A first bucket 62 is inserted into the left bucket receiving passage 90 formed by the band 58. The upper tongue 44 is held up and out as the bucket 62 slides into the left bucket band 58. A second bucket is inserted into the right bucket receiving passage 92 formed by the band 60. The upper tongue 48 is held up and out as the bucket slides into the bucket band 60. The bucket bands 58 and 60 have vertical heights that are around half the height of the bucket. As shown in the drawing, the vertical height of each of the bucket bands 58 and 60 exceeds one-half the height of the bucket 62. The bucket bands 58 and 60 tighten on the bucket side walls 64 and preferably hold the bottom flange 70 of a bucket 62 above the upper edges 32 or 36 of the bucket bands. With these bucket bands 58 and 60 there are no buckles to catch on things and no adjustments to be made in the carrier.

The anti-abrasion flaps 52 and 54 are positioned between the side of the snowmobile housing for the snow-engaging traction belt 84 as well as between the bucket bottom 66 and the top surface 86 of the footrest plate 88. The purpose of the anti-abrasion flaps is to prevent the bucket from abrading the snowmobile and the snowmobile footrest plate 88. To perform the intended function, the anti-abrasion flaps 52 and 54 should cover about two-thirds of the bucket bottom 66.

The bucket carrier 10 holds the entire bucket 62 up above the footrest 88 when the buckets are empty. When the buckets 62 are above half full the bucket carrier 10 stretches, the seat 88 compresses somewhat and the weight is transferred from the bucket bottom 66 through an anti-abrasion flap 52 or 54 and to the footrest plate 88.

A bucket carrier 10 made from a bucket carrier blank 12 with a thickness of 45 mils can carry about 35 to 45 pounds in two buckets 62. A bucket carrier 10 made from a carrier blank 12 with a thickness of 60 mils can carry between 45 and 50 pounds in two buckets 62.

The bucket carrier 10 can carry buckets 62 on vehicles other than snowmobiles 82. The other vehicles include some all terrain vehicles, personal watercraft, motorcycles, garden tractors and even bicycles. Some adjustment of length of a central strip 14 may be required for different vehicles. Horses and other domestic animals can also carry two buckets 62 with the bucket carrier 10. The bucket carrier 10 may also be constructed to hold buckets 62 with different diameters. It is desirable to construct the bucket carrier to fit the buckets 62 that are used as well as the snowmobile 82 or other vehicle.

I claim:

1. A bucket carrier made from rubber sheet material comprising:

a central strip with a left end and a right end;

a left front band portion with a left front band upper edge integral with the left end of the central strip, a left front band lower edge, a left front band free end, and a left rear band portion integral with the central strip and the left front band portion;

a right front band portion with a right front band upper edge integral with the right end of the central strip, a right front band lower edge, a right front band free end, and a right rear band portion integral with the central strip and the right front band portion;

a left joint connecting the left front band free end to the left rear band portion to form a left bucket band with a frustoconical left bucket receiving passage;

a right joint connecting the right band free end to the right rear portion to form a right bucket band with a frustoconical right bucket receiving passage;

a left upper tongue integral with a left bucket band upper edge; and a right upper tongue integral with a right bucket band upper edge.

2. A bucket carrier, as set forth in claim 1, including a left lower tongue integral with a left bucket band lower edge, and a right lower tongue integral with a right bucket band lower edge.

3. A bucket carrier, as set forth in claim 1, including a first anti-abrasion flap integral with the left bucket band lower edge, and a second anti-abrasion flap integral with the right bucket band lower edge.

* * * * *